US011035636B2

(12) United States Patent
Muska

(10) Patent No.: US 11,035,636 B2
(45) Date of Patent: Jun. 15, 2021

(54) SHOTGUN AMMUNITION FEEDING SYSTEM

(71) Applicant: Smith & Wesson Inc., Springfield, MA (US)

(72) Inventor: Simon M. Muska, Enfield, CT (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/924,525

(22) Filed: Jul. 9, 2020

(65) Prior Publication Data

US 2021/0025666 A1 Jan. 28, 2021

Related U.S. Application Data

(60) Provisional application No. 62/878,826, filed on Jul. 26, 2019, provisional application No. 62/899,425, filed on Sep. 12, 2019.

(51) Int. Cl.

| | |
|---|---|
| ***F41A 9/61*** | (2006.01) |
| ***F41A 9/72*** | (2006.01) |
| ***F41A 17/34*** | (2006.01) |
| ***F41C 7/02*** | (2006.01) |
| ***F41A 3/66*** | (2006.01) |

(52) U.S. Cl.

CPC ..... *F41A 9/72* (2013.01); *F41A 3/66* (2013.01); *F41A 17/34* (2013.01); *F41C 7/02* (2013.01)

(58) Field of Classification Search

CPC ..... F41A 9/61; F41A 9/68; F41A 9/72; F41A 9/37; F41A 9/58

See application file for complete search history.

(56) References Cited

U.S. PATENT DOCUMENTS

| | | | |
|---|---|---|---|
| 1,344,991 | A | 6/1920 | Cunningham |
| 1,386,247 | A | 8/1921 | Fordyce |
| 1,637,400 | A | 8/1927 | Von Kiraly et al. |
| 1,709,399 | A | 4/1929 | Herlach et al. |
| 1,801,072 | A | 4/1931 | Browning |
| 1,801,073 | A | 4/1931 | Browning |
| 1,803,352 | A | 5/1931 | Tansley |
| 1,818,984 | A | 8/1931 | Browning |
| 1,878,038 | A | 9/1932 | Frommer |

(Continued)

FOREIGN PATENT DOCUMENTS

| | | |
|---|---|---|
| CH | 175058 | 2/1935 |
| DE | 202004016026 | 1/2005 |

(Continued)

*Primary Examiner* — J. Woodrow Eldred

(74) *Attorney, Agent, or Firm* — John A. Chionchio, Esq.; Ballard Spahr LLP

(57) ABSTRACT

A shotgun has right and left magazines from which ammunition may be fed to the action using a selector mounted on a movable fore-end chassis whose motion cycles the action. An interrupter prevents the selector from switching between magazines unless the action is in battery with the fore-end chassis fully forward toward the muzzle end of the shotgun. Respective right and left outer cut-offs on the magazines cooperate with an inner cut-off to ensure proper coordination of ammunition feed as the action is cycled by motion of the fore-end chassis. The outer cut-offs are also manually operable to permit removal of ammunition from the magazines without cycling the action.

36 Claims, 11 Drawing Sheets

(56) References Cited

U.S. PATENT DOCUMENTS

| | | | | |
|---|---|---|---|---|
| 1,892,259 | A | 12/1932 | Frommer | |
| 1,907,164 | A | 5/1933 | White | |
| 1,911,494 | A | 5/1933 | Floyd | |
| 2,016,646 | A | 10/1935 | Mancini | |
| 2,047,789 | A | 7/1936 | Loomis | |
| 2,196,852 | A | 4/1940 | Browning | |
| 2,391,756 | A | 12/1945 | Vesely | |
| 2,562,037 | A | 7/1951 | Humeston | |
| 2,637,247 | A | 5/1953 | Hester | |
| 2,970,398 | A | 2/1961 | Crouch | |
| 3,020,662 | A | 2/1962 | Merkel | |
| 3,075,511 | A | 1/1963 | Ryan | |
| 3,077,044 | A | 2/1963 | Reed | |
| 3,101,703 | A | 8/1963 | Ryan | |
| 3,233,546 | A | 2/1966 | Foote et al. | |
| 3,399,481 | A | 9/1968 | Giorgini | |
| 3,512,290 | A | 5/1970 | Violette, Jr. et al. | |
| 3,570,366 | A | 3/1971 | Nickel | |
| 3,611,869 | A | 10/1971 | Hupp | |
| 3,630,118 | A | 12/1971 | Stoner | |
| 3,731,588 | A | 5/1973 | Curtis et al. | |
| 3,744,371 | A | 7/1973 | McFarland | |
| 3,766,825 | A | 10/1973 | Robinson | |
| 3,768,190 | A | 10/1973 | Ruger et al. | |
| 3,810,326 | A | 5/1974 | Hilberg et al. | |
| 3,999,461 | A | 12/1976 | Johnson et al. | |
| 4,004,489 | A | 1/1977 | Johnson et al. | |
| 4,022,105 | A | 5/1977 | White | |
| 4,061,074 | A | 12/1977 | Johnson et al. | |
| 4,069,740 | A | 1/1978 | Hollinger et al. | |
| 4,119,012 | A | 10/1978 | Frye | |
| 4,223,589 | A | 9/1980 | Post | |
| 4,395,937 | A | 8/1983 | Ottolini | |
| 4,463,654 | A | 8/1984 | Barnes et al. | |
| 4,562,659 | A | 1/1986 | Neta | |
| 4,601,123 | A | 7/1986 | Swearengen et al. | |
| 4,635,530 | A | 1/1987 | Weldle | |
| 4,663,876 | A | 5/1987 | Reaume | |
| 4,677,781 | A | 7/1987 | Lee | |
| 4,709,617 | A | 12/1987 | Anderson | |
| 4,821,442 | A * | 4/1989 | Bock | F41A 9/72 42/17 |
| 4,856,410 | A | 8/1989 | Anderson | |
| 4,867,039 | A | 9/1989 | Dobbins | |
| 4,869,008 | A | 9/1989 | Rasmussen | |
| 4,882,973 | A | 11/1989 | Piscetta | |
| 4,932,148 | A | 6/1990 | Barrett | |
| 4,944,109 | A | 7/1990 | Zedrosser | |
| 5,119,575 | A | 6/1992 | Gajdica | |
| 5,171,934 | A | 12/1992 | Moore | |
| 5,235,769 | A | 8/1993 | Stead et al. | |
| 5,361,700 | A | 11/1994 | Carbone | |
| 5,367,810 | A | 11/1994 | Stead et al. | |
| 5,675,110 | A | 12/1997 | Gyre et al. | |
| 5,827,991 | A | 10/1998 | Predazzer | |
| 5,834,678 | A | 11/1998 | Kalb | |
| 6,135,005 | A | 10/2000 | Dobbins | |
| 6,415,701 | B1 | 11/2002 | Dobbins | |
| 6,481,144 | B1 | 11/2002 | Chee et al. | |
| 6,779,461 | B1 | 8/2004 | Olson et al. | |
| 6,860,207 | B1 | 3/2005 | Robertson | |
| 6,877,265 | B2 | 4/2005 | Hajar et al. | |
| 7,047,684 | B2 | 5/2006 | Roh | |
| 7,066,092 | B2 | 6/2006 | Olson et al. | |
| 7,069,863 | B2 | 7/2006 | Olson et al. | |
| 7,165,352 | B2 | 1/2007 | Langlotz | |
| 7,231,864 | B2 | 6/2007 | Ratti | |
| 7,252,038 | B2 | 8/2007 | Olson et al. | |
| 7,356,958 | B2 | 4/2008 | Weir | |
| 7,380,361 | B2 | 6/2008 | Hajar et al. | |
| 7,448,307 | B1 | 11/2008 | Datinov | |
| 7,451,706 | B2 | 11/2008 | Meyer | |
| 7,469,496 | B1 | 12/2008 | Kellgren | |
| 7,493,718 | B2 | 2/2009 | Gorzen | |
| 7,634,959 | B2 | 12/2009 | Frickey | |
| 7,814,695 | B1 | 10/2010 | Keeney et al. | |
| 7,921,779 | B1 | 4/2011 | Olson et al. | |
| 7,966,762 | B2 | 6/2011 | Barrett | |
| 8,122,635 | B2 | 2/2012 | Pullicar | |
| 8,161,886 | B2 | 4/2012 | Meyer | |
| 8,261,479 | B2 | 9/2012 | Barrett | |
| 8,353,123 | B2 | 1/2013 | Pullicar et al. | |
| 8,615,915 | B2 | 12/2013 | Hunter et al. | |
| 8,683,725 | B2 | 4/2014 | Munson | |
| 8,683,726 | B1 | 4/2014 | Genton | |
| 8,733,007 | B2 | 5/2014 | Hatfield | |
| 8,782,940 | B1 | 7/2014 | Morris | |
| 8,806,788 | B1 | 8/2014 | Hu | |
| 8,819,976 | B1 | 9/2014 | Kellgren | |
| 8,826,577 | B1 | 9/2014 | Bentley | |
| 8,839,709 | B1 | 9/2014 | Crye et al. | |
| 8,869,672 | B2 | 10/2014 | Smith | |
| 8,925,234 | B1 | 1/2015 | Barrett | |
| 8,931,393 | B1 | 1/2015 | Vincent et al. | |
| 8,944,041 | B2 | 2/2015 | Hu | |
| 9,010,233 | B2 | 4/2015 | St. George | |
| 9,015,979 | B2 | 4/2015 | Safewright, Jr. | |
| 9,015,981 | B2 | 4/2015 | Zamlinsky | |
| 9,021,935 | B1 | 5/2015 | Kellgren | |
| 9,062,922 | B1 | 6/2015 | Burt et al. | |
| 9,097,476 | B2 | 8/2015 | Mead et al. | |
| 9,109,849 | B2 | 8/2015 | Young et al. | |
| 9,109,856 | B1 | 8/2015 | Zamlinsky | |
| 9,115,954 | B1 | 8/2015 | Corsi et al. | |
| 9,188,399 | B1 | 11/2015 | Findlay et al. | |
| 9,200,857 | B1 | 12/2015 | Kellgren | |
| 9,341,429 | B1 | 1/2016 | Reavis, III | |
| 9,347,725 | B2 | 5/2016 | McAlister | |
| 9,347,737 | B2 | 5/2016 | Troy et al. | |
| 9,534,861 | B1 | 1/2017 | Kellgren | |
| 9,562,731 | B2 | 2/2017 | Geissele | |
| 9,612,067 | B2 | 4/2017 | Boyarkin | |
| 9,759,504 | B2 | 9/2017 | Geissele | |
| 9,958,230 | B1 | 5/2018 | Nugent et al. | |
| 10,006,727 | B2 | 6/2018 | Barrett et al. | |
| 10,041,754 | B2 | 8/2018 | Tamir | |
| 10,088,257 | B2 | 10/2018 | Popikov et al. | |
| 10,145,631 | B2 | 12/2018 | Barrett et al. | |
| 10,161,709 | B1 | 12/2018 | Wright | |
| 10,288,369 | B2 | 5/2019 | Albury | |
| 10,317,156 | B2 | 6/2019 | Shaver | |
| 10,345,074 | B1 | 7/2019 | Zamlinskiy | |
| 10,605,548 | B1 | 3/2020 | Lukofnak, III | |
| 2005/0235546 | A1 | 10/2005 | Wonisch et al. | |
| 2007/0033850 | A1 | 2/2007 | Murello et al. | |
| 2007/0151438 | A1 | 7/2007 | Courty | |
| 2008/0121096 | A1 | 5/2008 | Hajar et al. | |
| 2009/0211140 | A1 | 8/2009 | Rolfe | |
| 2011/0209607 | A1 | 9/2011 | St. George | |
| 2013/0174456 | A1* | 7/2013 | Ricks | F41A 9/72 42/6 |
| 2013/0185975 | A1 | 7/2013 | Johnson | |
| 2014/0075803 | A1 | 3/2014 | Muller | |
| 2014/0075812 | A1 | 3/2014 | Johnson | |
| 2014/0261365 | A1* | 9/2014 | Atwell | F41A 9/58 124/83 |
| 2015/0107143 | A1 | 4/2015 | Coetzee et al. | |
| 2015/0316339 | A1 | 11/2015 | Young et al. | |
| 2016/0153732 | A1 | 6/2016 | Geissele | |
| 2018/0224233 | A1 | 8/2018 | Macy | |
| 2019/0186854 | A1 | 6/2019 | Berrett et al. | |
| 2019/0204034 | A1 | 7/2019 | Young et al. | |
| 2020/0348097 | A1* | 11/2020 | Akyol | F41A 9/72 |

FOREIGN PATENT DOCUMENTS

| | | |
|---|---|---|
| DE | 102007034671 | 1/2009 |
| DE | 102007034675 | 1/2009 |
| FR | 2231936 | 12/1974 |
| FR | 2502321 | 9/1982 |
| GB | 573429 | 6/1941 |
| RU | 2055296 | 2/1996 |
| WO | 200114819 | 3/2001 |
| WO | 2005015113 | 2/2005 |

(56) References Cited

FOREIGN PATENT DOCUMENTS

| | | |
|---|---|---|
| WO | WO2005015113 | 2/2005 |
| WO | 2012005829 | 1/2012 |
| WO | WO2012005829 | 1/2012 |

* cited by examiner

SHOTGUN AMMUNITION FEEDING SYSTEM

CROSS REFERENCE TO RELATED APPLICATIONS

This application is based upon and claims benefit of priority to U.S. Provisional Application No. 62/878,826, filed Jul. 26, 2019, and U.S. Provisional Application No. 62/899,425, filed Sep. 12, 2019, both of which are hereby incorporated by reference herein in their entirety.

FIELD OF THE INVENTION

This invention relates to ammunition feeding systems for shotguns having multiple magazines.

BACKGROUND

Shotguns for self-defense purposes may feature dual magazine tubes which provide expanded ammunition capacity. A desirable feature in such shotguns allows the operator to manually select the tube from which the ammunition feeds. For pump action operation, the action must reciprocate from battery to open breech and back into battery to the full extent of fore-end travel for proper operation of the feed system, which moves a shell from one of the magazines into the chamber. A manually operated selector is used to select the magazine tube from which the shell is removed and chambered.

If the magazine selector is manipulated during fore-end travel into battery before the return of the fore-end to the full extent of travel it may cause shells to be released from both magazine tubes simultaneously. The result will be a malfunction (known as "locking up") of the action. A mechanism which prevents the manipulation of the magazine selector in any position but at the full extent of fore-end travel is expected to avoid this malfunction.

SUMMARY

The invention concerns a feeding system for feeding ammunition to a firearm such as a shotgun. In an example embodiment the feeding system comprises a right magazine tube mountable on the firearm. The right magazine tube defines a right bore for receiving the ammunition. A right outer cut-off is mountable on the firearm. The right outer cut-off has a right blocking surface movable between a first position blocking the right bore and a second position not blocking the right bore. A right biasing spring acts on the right outer cut-off and biases the right blocking surface into the first position. A right cam follower is mounted on the right outer cut-off. A right cam is mountable on the firearm. The right cam is engageable with the right cam follower for moving the right blocking surface between the first and the second positions. A left magazine tube is mountable on the firearm. The left magazine tube defines a left bore for receiving the ammunition. A left outer cut-off is mountable on the firearm. The left outer cut-off has a left blocking surface movable between a first position blocking the left bore and a second position not blocking the left bore. A left biasing spring acts on the left outer cut-off and biases the left blocking surface into the first position. A left cam follower is mounted on the left outer cut-off. A left cam is mountable on the firearm. The left cam is engageable with the left cam follower for moving the left blocking surface between the first and the second positions.

A selector is mountable on the firearm. The selector has an activation surface in facing relation with the right and left cams. The selector is movable lengthwise along the first and second magazine tubes for engaging the activation surface with one of the left or right cams. The selector is movable transversely to the first and second magazine tubes for positioning the activation surface for engagement with one of the left or right cams.

An example feeding system according to the invention may further comprise an interrupter surface mountable on the firearm. An example interrupter surface extends lengthwise along the first and second magazine tubes. The interrupter surface has an end positioned distal to the right and left outer cut-offs. A boss extends from the selector. The boss is engageable with the interrupter surface when the selector is positioned between the end and the right and left outer cut-offs thereby preventing movement of the selector transversely to the right and left magazine tubes.

An example feeding system may further comprise an inner cut-off mountable on the firearm. An example inner cut-off has first and second blocking surfaces movable between a first position respectively blocking the right and the left bores, and a second position not blocking the right and left bores. An inner cam follower is mounted on the inner cut-off. An inner cut-off cam is mountable on the firearm in an example. The inner cut-off cam is engageable with the inner cam follower for moving the first and second blocking surfaces between the first and second positions. An inner cut-off cam actuator is movably mountable on the firearm by way of example. The inner cut-off cam actuator is movable into engagement with the inner cut-off cam for moving the first and second blocking surfaces between the first and second positions. An inner biasing spring acts on the inner cut-off and biasing the first and second blocking surfaces into the second position.

In an example feeding system the inner cut-off comprises a housing mountable on the magazine tubes. A lever is mounted on the housing and pivotable about an axis oriented transversely to the magazine tubes. Further by way of example, a feeding system may comprise a fore-end chassis mountable on the firearm and movable lengthwise along the right and left magazine tubes. The selector and the inner cut-off cam actuator are mounted on the fore-end chassis in this example.

In a particular example embodiment the right outer cut-off comprises a right lever pivotably mountable on the right magazine tube. The right blocking surface is mounted on one end of the right lever. The right cam follower is mounted on an opposite end of the right lever. Further by way of example, the left outer cut-off comprises a left lever pivotably mountable on the left magazine tube. The left blocking surface is mounted on one end of the left lever. The left cam follower is mounted on an opposite end of the left lever. By way of example, the right cam may comprise an elongate body slideably mountable on the right magazine tube and the left cam may comprise an elongate body slideably mountable on the left magazine tube.

In an example embodiment of a feeding system the selector may comprise a body mounted on the fore-end chassis and movable relatively thereto transversely to the right and left magazine tubes. The activation surface and the boss are mounted on the body. A right button projects from one side of the body transversely to the right and left magazine tubes. A left button projects from an opposite side of the body transversely to the right and left magazine tubes. The right and left buttons are adapted for manually moving the body transversely to the right and left magazine tubes.

In a particular example embodiment the interrupter surface comprises a wall mountable between the left and right magazine tubes. Further by way of example the right outer cut-off may comprise a right manual actuator surface extending therefrom and the left outer cut-off may comprise a left manual actuator surface extending therefrom. The right and left manual actuator surfaces permit manual moving of the right and left blocking surfaces between the first and second positions.

The invention also encompasses a shotgun. In an example embodiment the shotgun comprises a receiver. A barrel having a breech and a chamber is mounted on the receiver. A feeding system for feeding ammunition to the chamber is also provided. An example feeding system comprises a right magazine tube mounted on the receiver. The right magazine tube defines a right bore for receiving the ammunition. A right outer cut-off is mounted on the receiver. The right outer cut-off has a right blocking surface movable between a first position blocking the right bore and a second position not blocking the right bore. A right biasing spring acts on the right outer cut-off for biasing the right blocking surface into the first position. A right cam follower is mounted on the right outer cut-off. A right cam is mounted on the receiver. The right cam is engageable with the right cam follower for moving the right outer cut-off between the first and the second positions. A left magazine tube is mounted on the receiver. The left magazine tube defines a left bore for receiving the ammunition. A left outer cut-off is mounted on the receiver. The left outer cut-off has a left blocking surface movable between a first position blocking the left bore and a second position not blocking the left bore. A left biasing spring acts on the left outer cut-off for biasing the left blocking surface into the first position. A left cam follower is mounted on the left outer cut-off. A left cam is mounted on the receiver. The left cam is engageable with the left cam follower for moving the left blocking surface between the first and the second positions. A selector is mounted on the receiver. The selector has an activation surface in facing relation with the right and left cams. The selector is movable lengthwise along the first and second magazine tubes for engaging the activation surface with one of the left or right cams. The selector is movable transversely to the first and second magazine tubes for positioning the activation surface for engagement with one of the left or right cams.

By way of example a shotgun according to the invention may further comprise an interrupter surface mounted on the receiver. An example interrupter surface may extend lengthwise along the first and second magazine tubes. The interrupter surface has an end positioned distal to the right and left outer cut-offs. A boss extends from the selector. The boss is engageable with the interrupter surface when the selector is positioned between the end and the right and left outer cut-offs thereby preventing movement of the selector transversely to the right and left magazine tubes.

An example shotgun may further comprise an inner cut-off mounted on the receiver. An example inner cut-off may have first and second blocking surfaces movable between a first position respectively blocking the right and the left bores, and a second position not blocking the right and left bores. An inner cam follower is mounted on the inner cut-off. An inner cut-off cam is mountable on the shotgun. The inner cut-off cam is engageable with the inner cam follower for moving the first and second blocking surfaces between the first and second positions. An inner cut-off cam actuator may be movably mounted on the receiver. The inner cut-off cam actuator is movable into engagement with the inner cut-off cam for moving the first and second blocking surfaces between the first and second positions. An inner biasing spring acts on the inner cut-off and biases the first and second blocking surfaces into the second position.

An example the inner cut-off may comprise a housing mounted on the magazine tubes. A lever is mounted on the housing and is pivotable about an axis oriented transversely to the magazine tubes in this example.

A shotgun according to the invention may further comprise a fore-end chassis mounted on the receiver. The fore-end chassis is movable lengthwise along the right and left magazine tubes. The selector and the inner cut-off cam actuator are mounted on the fore-end chassis.

In an example embodiment the right outer cut-off may comprise a right lever pivotably mounted on the right magazine tube. The right blocking surface is mounted on one end of the right lever, and the right cam follower is mounted on an opposite end of the right lever in this embodiment.

In an example embodiment, the left outer cut-off comprises a left lever pivotably mounted on the left magazine tube. The left blocking surface is mounted on one end of the left lever, and the left cam follower is mounted on an opposite end of the left lever.

In a specific example embodiment the right cam comprises an elongate body slidably mounted on the right magazine tube. Also by way of example, the left cam comprises an elongate body slidably mounted on the left magazine tube. In an example embodiment the selector may comprise a body mounted on the fore-end chassis. The body is movable relatively to the fore-end chassis transversely to the right and left magazine tubes. The activation surface and the boss may be mounted on the body. A right button projects from one side of the body transversely to the right and left magazine tubes. A left button projects from an opposite side of the body transversely to the right and left magazine tubes. The right and left buttons are adapted for manually moving the body transversely to the right and left magazine tubes.

In an example embodiment the interrupter surface may comprise a wall mounted on the receiver between the left and right magazine tubes. Further by way of example the right outer cut-off may comprise a right manual actuator surface extending therefrom, and the left outer cut-off may comprise a left manual actuator surface extending therefrom. The right and left manual actuator surfaces permit manual moving of the right and left blocking surfaces between the first and second positions in this example.

The invention further encompasses a selector mountable on a shotgun having a plurality of ammunition magazines wherein respective cams for releasing the ammunition from the magazines are associated with each magazine. In an example embodiment the selector comprises a selector body defining an activation surface positionable in facing relation with the cams one at a time. The selector body is mountable on the shotgun and movable relatively to the cams for engaging the activation surface with a selected one of the cams. In a particular example the selector body is movable transversely to the magazines for positioning the activation surface in facing relation with the selected one of the cams. The selector body may also be movable lengthwise along the magazines for engagement of the activation surface with the selected one of the cams.

A selector according to the invention may further comprise an interrupter surface mountable on the shotgun. The interrupter surface may extend lengthwise along the magazines and have an end positionable distal to the cams. A boss extends from the selector. The boss is engageable with the interrupter surface when the selector is positioned between the end and the cams thereby preventing movement of the selector transversely to the magazines.

The invention also includes shotgun, which, by way of example comprises a plurality of ammunition magazines and respective cams for releasing ammunition from the magazines associated with each cam. The example shotgun may also comprise a selector. In a specific example the selector comprises a selector body mounted on the shotgun. The selector body defines an activation surface positionable in facing relation with the cams one at a time. The selector body is movable relatively to the cams for engaging the activation surface with a selected one of the cams.

By way of example the selector body is movable transversely to the magazines for positioning the activation surface in facing relation with a selected one of the cams. Further by way of example, the selector body may be movable lengthwise along the magazines for engagement of the activation surface with a selected one of the cams. An example shotgun may further comprise an interrupter surface mounted on the shotgun. The interrupter surface may extend lengthwise along the magazines in an example embodiment and have an end positionable distal to the cams. A boss extends from the selector. The boss is engageable with the interrupter surface when the selector is positioned between the end and the cams to thereby prevent movement of the selector transversely to the magazines. A further example comprises a fore-end chassis movably mounted thereon. The selector body is mounted on the fore-end chassis in this example. The example shotgun may also include an action. The fore-end chassis is connected to the action, such that motion of the fore-end chassis cycles the action into and out of battery during operation of the shotgun.

An example shotgun according to the invention may comprise a plurality of ammunition magazines and respective cut-offs for releasing ammunition from the magazines associated with each cut-off. Each of the cut-offs has a blocking surface movable between a first position blocking one of the magazines and a second position not blocking the one of the magazines. At least one of the cut-offs has a manual actuator surface extending therefrom. The manual actuator surface permits manual moving of the blocking surface of the at least one cut-off between the first and second positions. In an example shotgun according to the invention the at least one cut-off may comprise a lever pivotably mounted on one of the magazines. The blocking surface of the at least one cut-off is mounted proximate to one end of the lever. The manual actuator surface is mounted proximate to an opposite end of the lever in this example.

DETAILED DESCRIPTION

Figure 1:
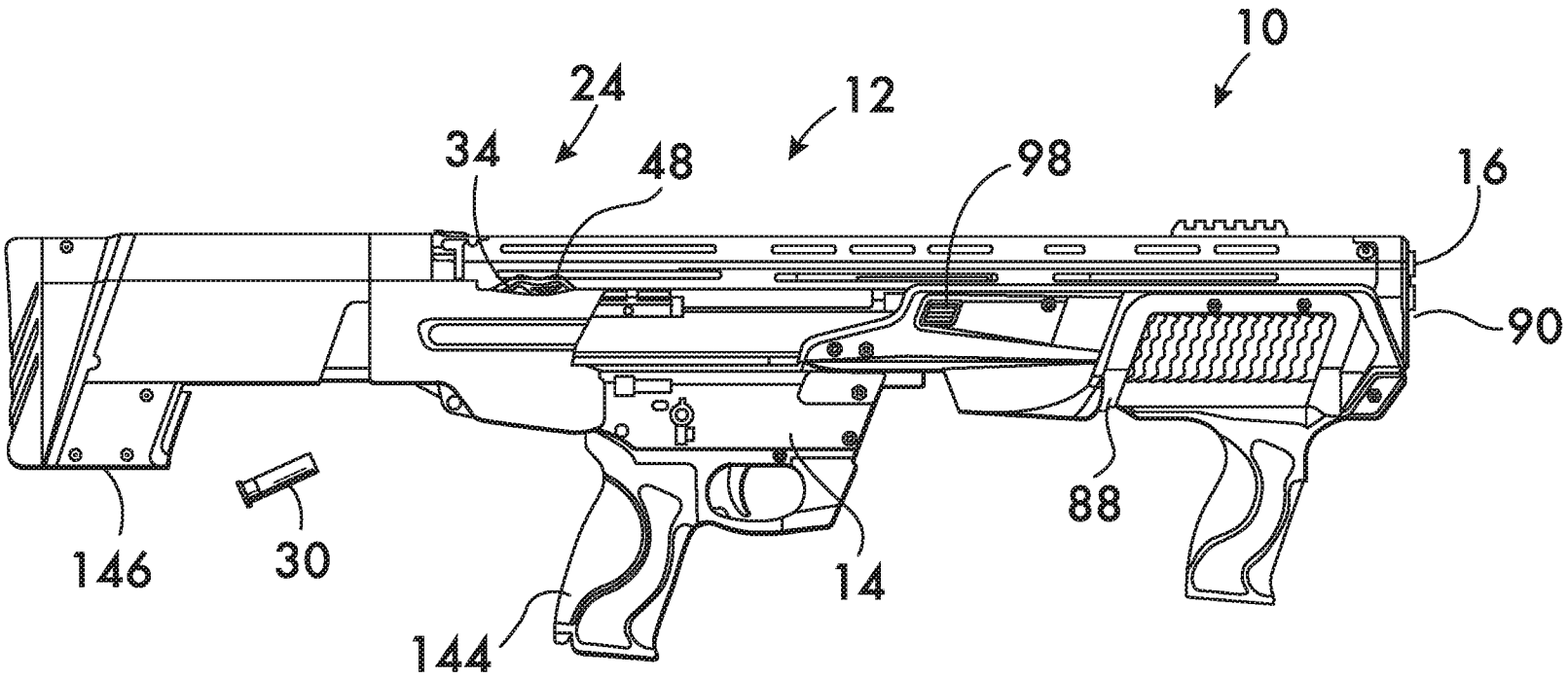
FIG. 1 is a side view of a shotgun having an example ammunition feeding system according to the invention.
Figure 2:
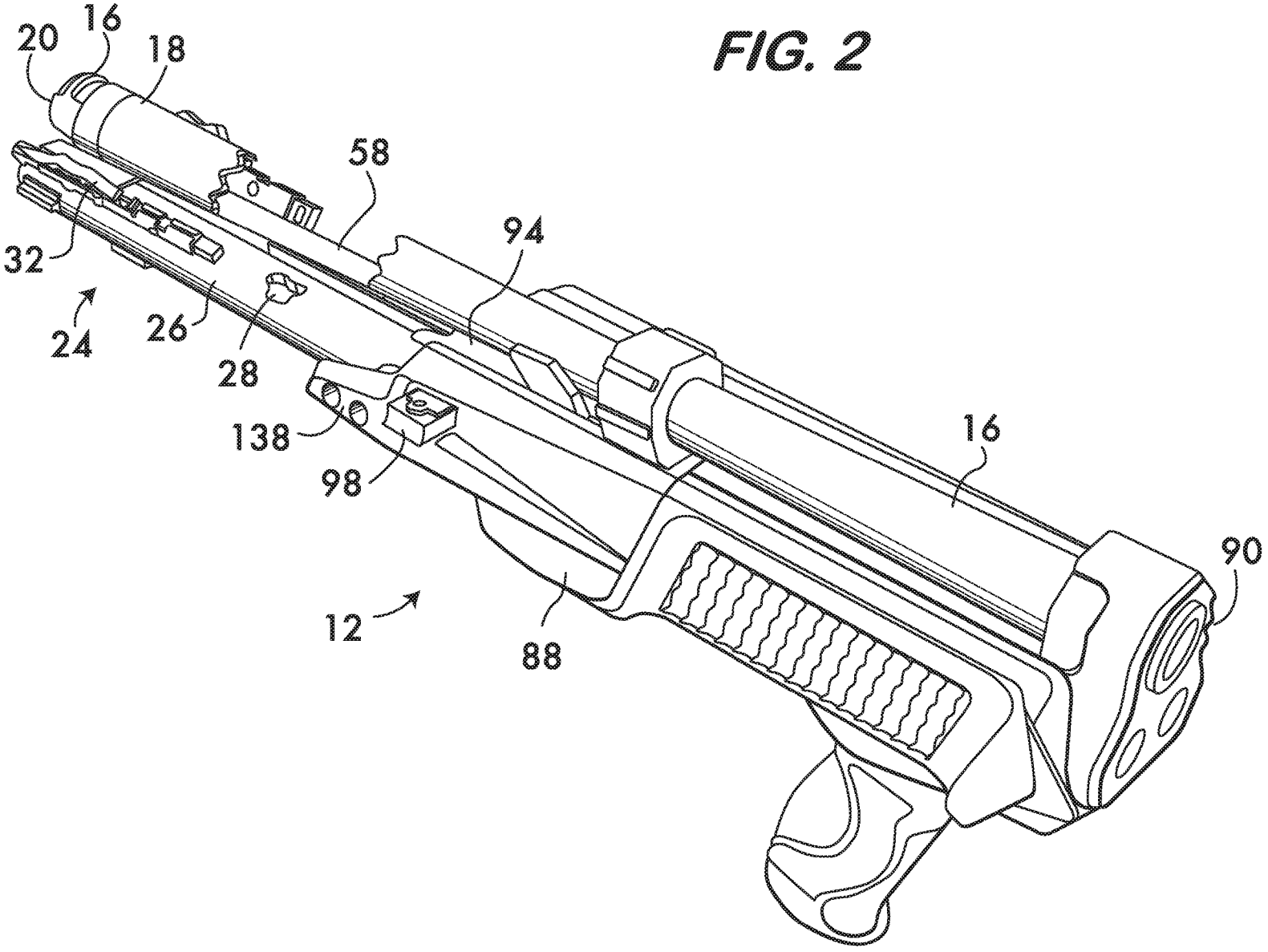
FIG. 2 is an isometric view of a portion of the receiver of the shotgun shown in FIG. 1.

FIG. 1 shows a firearm, in this example a self-defense shotgun 10 according to the invention. Shotgun 10 comprises a receiver 12 which houses a fire control group 14. As also shown in FIG. 2, a barrel 16 is mounted on receiver 12, the barrel having a chamber 18 and breech 20, the breech being opened and closed by a breech block (not shown) movable into and out of battery. A feeding system 24 for feeding ammunition to the chamber 18 is also mounted on the receiver 12.

Figure 3:
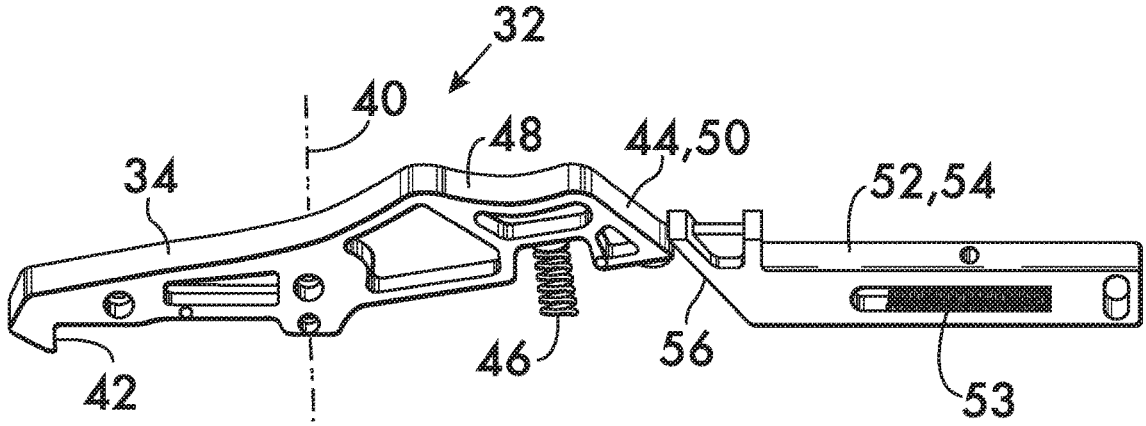
FIGS. 3 and 3A are isometric views of components used in an example outer cut-off according to the invention.
Figure 5:
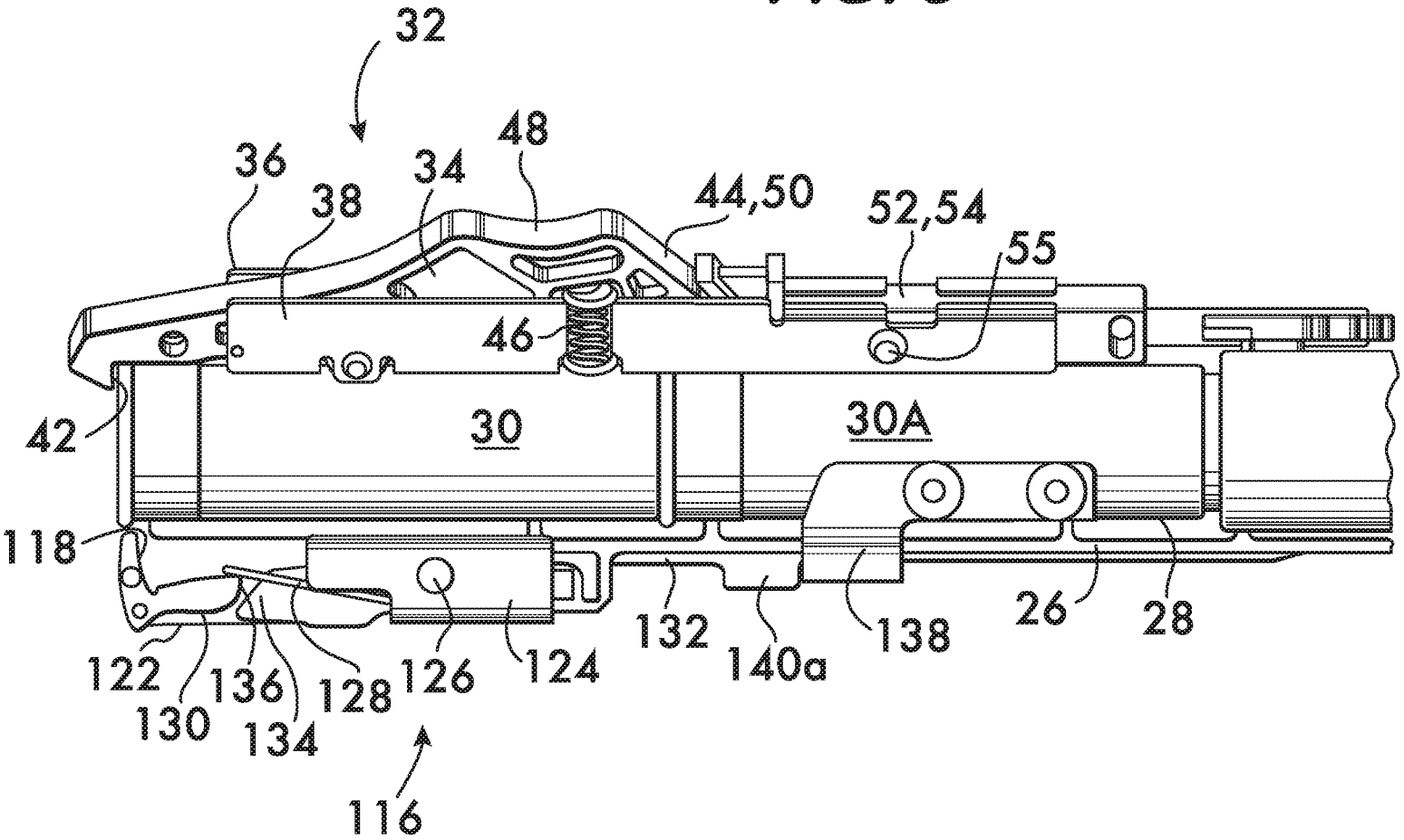
FIGS. 5-9 are isometric views illustrating operation of an example feeding mechanism according to the invention.

FIG. 2 shows an example feeding system 24 according to the invention. Example feeding system 24 comprises a right magazine tube 26 mounted on the receiver 12, the right magazine tube defining a right bore 28 for receiving the ammunition 30 (see FIG. 5). A right outer cut-off 32 is mounted on the receiver 12. In this example, the right outer cut-off 32 is mounted directly on the right magazine tube 26 and thus indirectly mounted on receiver 12. As shown in FIG. 5, the right outer cut-off 32 comprises a right lever 34 mounted within a channel 36 defined by two sidewalls 38 projecting from the right magazine tube 26. As shown in FIG. 3, right lever 34 is pivotable about an axis 40 oriented transversely to the right magazine tube 26. A right blocking surface 42 is mounted on one end of the right lever 34, and a right cam follower 44 is mounted on an opposite end of the right lever. Upon pivoting motion of the right lever 34 about axis 40, the right blocking surface 42 is movable between a first position, shown in FIG. 5, blocking the right bore 28 of the right magazine tube 26, and a second position, shown in FIG. 7, not blocking the right bore. When in the first position, shown in FIG. 5, the right outer cut-off 32 engages and retains ammunition 30 within the right magazine tube 26; when in the second position, shown in FIG. 7, the right outer cut-off 32 permits the ammunition to be released from the right magazine tube 26. As is well understood, individual rounds of ammunition are biased toward the right blocking surface 42 by a spring (not shown) within the magazine tube. As shown in FIGS. 3 and 5, a right biasing spring 46 acts on the right outer cut-off 32 for biasing the right blocking surface 42 into the first position. However, the right outer cut-off 32 further comprises a right manual actuator surface 48. As shown in FIG. 1, the right manual actuator surface 48 extends from the right lever 34 and projects proud of the receiver 12. This configuration permits ready manual access to the right outer cut-off 32 which may thus be pivoted between the first and second positions to release rounds of ammunition 30 from the right magazine tube 26 without cycling the action of the shotgun 10 as described below.

FIGS. 3 and 5 also show the right cam follower 44 mounted on the right outer cut-off 32. In this example, the right cam follower 44 comprises an angularly oriented right ramp surface 50 which interfaces with a right cam 52 also mounted on the receiver 12. As shown in FIGS. 3 and 5, the right cam 52 comprises an elongate body 54 slidably mounted within the channel 36 on the right magazine tube 26. One end of body 54 comprises a complementary ramp surface 56 which engages the right ramp surface 50 of lever 34. Engagement between the angularly oriented ramp surfaces 50 and 56 permits sliding motion of the right cam 52 toward the right outer cut-off to pivot the right outer cut-off clockwise (as seen in the figures) from the first to the second position to release a round of ammunition 30 from the right magazine tube 26 (compare FIGS. 5 and 7). The right biasing spring 46 pivots the right outer cut-off 32 counterclockwise and back into the second (blocking) position when force is no longer applied to the right cam 52. A return spring 53, positioned within the elongate body 54, acts between the elongate body and a pin 55 fixed within the channel 36 (see FIG. 5) to force the right cam 52 away from the right outer cut-off 32 when force is no longer applied to the right cam.

Figure 3A:
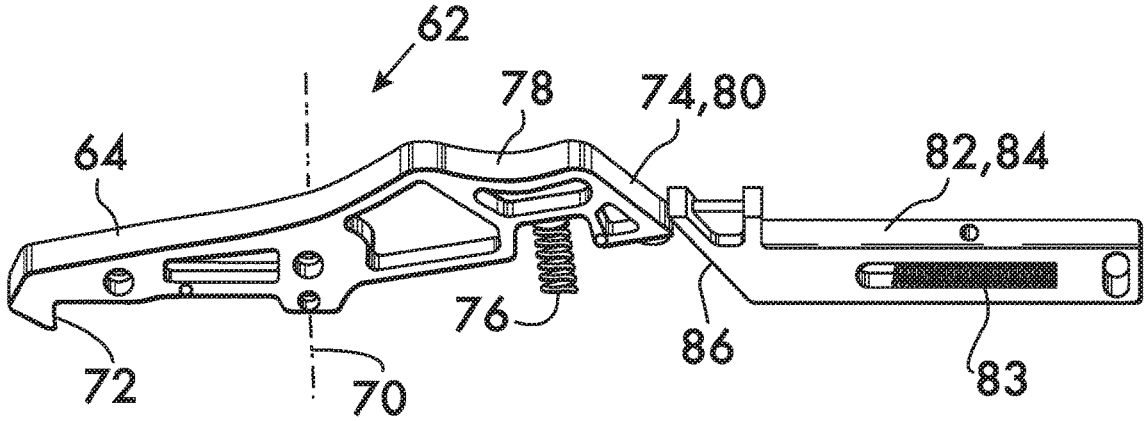
Figure 10:
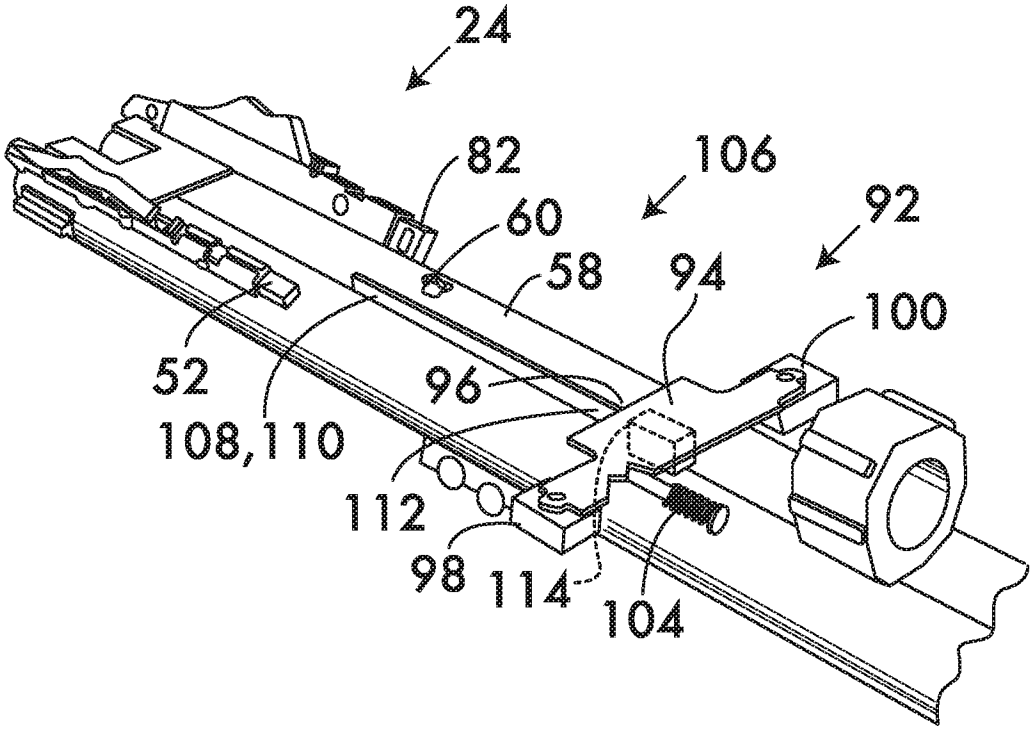
FIG. 10 is an isometric view of a portion of the receiver of the shotgun shown in FIG. 1 illustrating an example magazine selector according to the invention.
Figure 11:
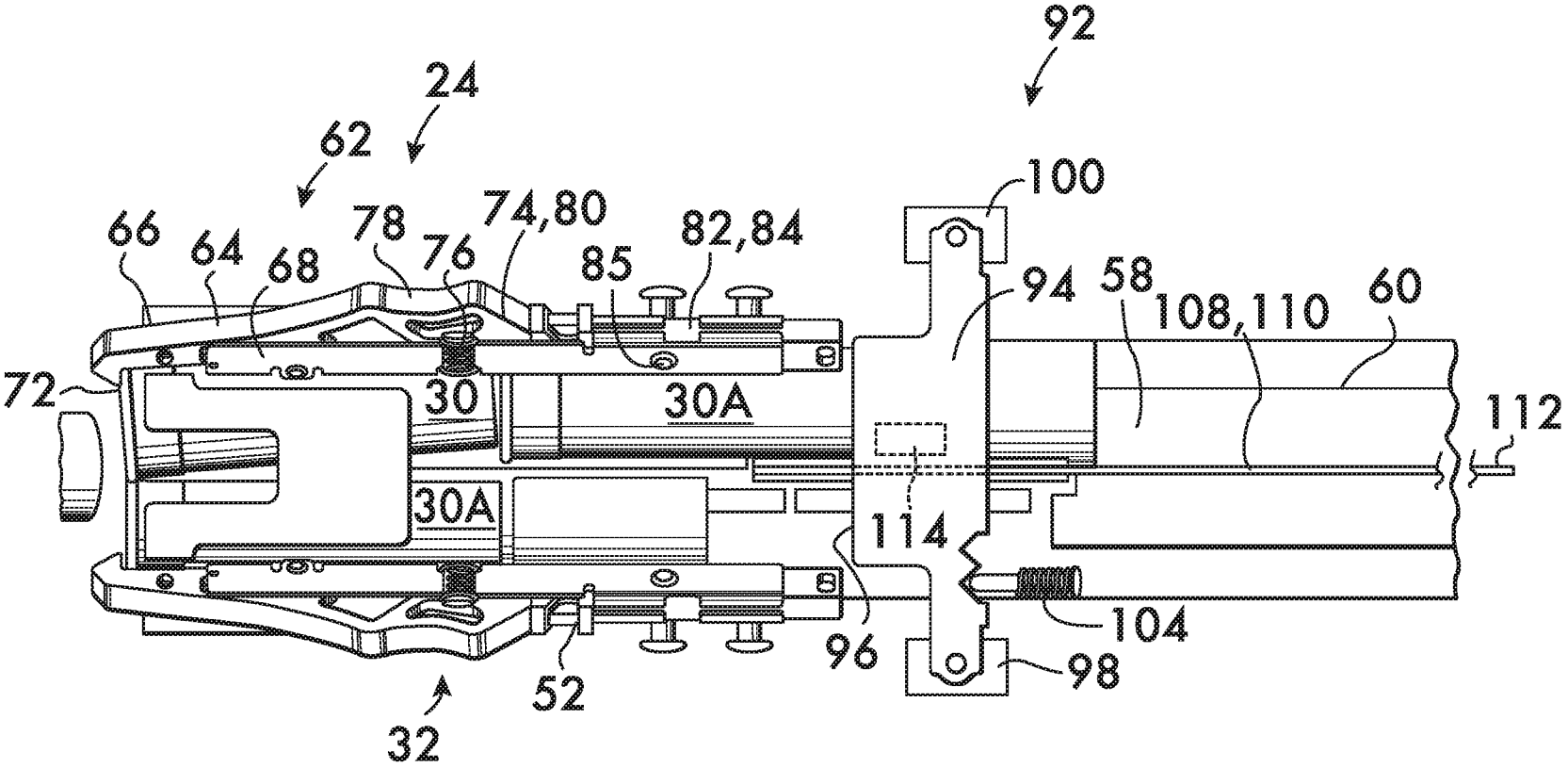
FIG. 11 is a top view of an example selector interrupter according to the invention.

As shotgun 10 is a self-defense shotgun, its feeding system 24 coordinates the feeding of ammunition 30 to the chamber 18 from either the right magazine tube 26 or a left magazine tube 58 shown in FIG. 2. FIGS. 10 and 11 show the example feeding system 24 comprising the left magazine tube 58 mounted on the receiver 12. The left magazine tube 58 defines a left bore 60 for receiving the ammunition 30 (see FIG. 11). A left outer cut-off 62 is mounted on the receiver 12. In this example, the left outer cut-off 62 is mounted directly on the left magazine tube 58 and is thus indirectly mounted on receiver 12. As shown in FIGS. 3A and 11, the left outer cut-off 62 comprises a left lever 64 mounted within a channel 66 defined by two sidewalls 68 projecting from the left magazine tube 58. Left lever 64 is pivotable about an axis 70 oriented transversely to the left magazine tube 58. A left blocking surface 72 is mounted on one end of the left lever 64, and a left cam follower 74 is mounted on an opposite end of the left lever. Similar to the right lever, pivoting motion of the left lever 64 about its axis 70 moves the left blocking surface 72 between a first position blocking the left bore 60 of the left magazine tube 58, and a second position, not blocking the left bore. When in the first position, the left outer cut-off 62 engages and retains ammunition 30 within the left magazine tube 58; when in the second position, the left outer cut-off 62 permits the ammunition to be released from the left magazine tube 58. As is well understood, individual rounds of ammunition are biased toward the left blocking surface 72 by a spring (not shown) within the left magazine tube. As shown in FIGS. 3A and 11, a left biasing spring 76 acts on the left outer cut-off 62 for biasing the left blocking surface 72 into the first position. However, the left outer cut-off 62 further comprises a left manual actuator surface 78. Similar to the right manual actuator surface 48 shown in FIG. 1, the left manual actuator surface 78 extends from the left lever 64 and also projects proud of the receiver 12. This configuration permits ready manual access to the left outer cut-off 62 which may thus be pivoted between the first and second positions to release rounds of ammunition 30 from the left magazine tube 58 without cycling the action of the shotgun 10 as described below.

FIGS. 3A and 11 also show the left cam follower 74 mounted on the left outer cut-off 62. In this example, the left cam follower 74 comprises an angularly oriented left ramp surface 80 which interfaces with a left cam 82 also mounted on the receiver 12. As shown in FIGS. 3A and 11, the left cam 82 comprises an elongate body 84 slidably mounted within the channel 66 on the left magazine tube 58. One end of body 84 comprises a complementary ramp surface 86 which engages the left ramp surface 80. Engagement between the angularly oriented ramp surfaces 80 and 86 permits sliding motion of the left cam 82 toward the left outer cut-off 62 to pivot the left outer cut-off from the first to the second position to release a round of ammunition 30 from the left magazine tube 58. The left biasing spring 76 pivots the left outer cut-off 62 counterclockwise and back into the second (blocking) position when force is no longer applied to the left cam 82. A return spring 83, positioned within the elongate body 84, acts between the elongate body and a pin 85 fixed within the channel 66 (see FIG. 11) to force the left cam 82 away from the left outer cut-off 62 when force is no longer applied to the left cam.

As shown in FIGS. 1 and 2, shotgun 10 comprises a fore-end chassis 88 mounted on the receiver 12 and movable lengthwise along the right and left magazine tubes 26 and 58. Shotgun 12 has a "pump action", wherein motion of the fore-end chassis 88 away from the shotgun's muzzle end 90 (motion out of battery) opens the breech 20, extracts and ejects the chambered round if any (spent or live), cocks the striking mechanisms, resets the fire control group 14 and releases the next round of ammunition from one of the magazines. Motion of the fore-end chassis 88 toward the muzzle end 90 (motion into battery) chambers the next round and closes the breech.

Coordination of ammunition feed from the right and left magazine tubes 26 and 58 to the chamber 18 is effected through a selector 92 mounted on the receiver 12 and shown in FIGS. 2, 10 and 11. In the example embodiment shown, selector 92 comprises a body 94 mounted on the fore-end chassis 88 and movable relatively thereto transversely to the right and left magazine tubes 26 and 58. An activation surface 96 is mounted on the selector body 94 in facing relation with the right and left cams 52 and 82. As shown by a comparison of FIGS. 10 and 11, transverse motion of the selector body 94 aligns the activation surface 96 with one of the right or left cams 52 and 82 such that lengthwise motion of the fore-end chassis 88 along the magazine tubes 26 and 58 toward the cams will bring the activation surface 96 into engagement with one of them. FIG. 10 shows the activation surface 96 aligned so as to engage the right cam 52 and thereby release a round from the right magazine tube 26 as described below, and FIG. 11 shows activation surface 96 aligned so as to engage the left cam 82. To permit manual manipulation of the selector 92, a right button 98 projects from one side of the selector body 94 transversely to the right and left magazine tubes 26 and 58, and a left button 100 projects from an opposite side of the selector body transversely to the right and left magazine tubes. The right and left buttons 98 and 100 are adapted for manually moving of the selector body 94 transversely to the right and left magazine tubes 26 and 58 to align the activation surface 96 with one of the right or left cams 52 and 82. In this example embodiment, pushing the left button 100 toward the right magazine tube 26 selects the right magazine tube as the tube from which the next round will be released (FIG. 10). Likewise, pushing the right button 98 toward the left magazine tube 58 selects the left magazine tube as the tube from which the next round will be released (FIG. 11). As shown in FIG. 2, it is advantageous that the right or left button project proud from the fore-end chassis 88 on the same side of the receiver 12 of the selected magazine. The buttons thus serve as visual and tactile indicators as to the magazine selected. Indicia may also be positioned on the buttons to provide a further visual indication as to the selected feeding magazine. As shown in FIG. 11, a spring and plunger detent 104 acting between the fore-end chassis 88 and the selector body 94 will help maintain the selector body securely in a desired position yet allow the selector body to be moved readily to select either magazine tube.

Shotguns for self-defense purposes having multiple magazines may suffer from a malfunction known as "lock up", where a second shell is released from a magazine before a first shell has been chambered. This may occur, for example, when a first shell is released from one of the magazines and the selector is then switched and the user releases a second shell out of the other magazine by again drawing the fore-end chassis back out of battery before completion of a full return stroke chambering the previously released first shell. The first shell will not have completed its feeding cycle, and with the release of the second shell there will thus be two shells attempting to feed into the chamber as the fore-end chassis is subsequently moved to place the action in battery. The result will be the "locking up" of the action which remains out of battery without a shell chambered until the two shells are cleared from the firearm.

Figure 12:
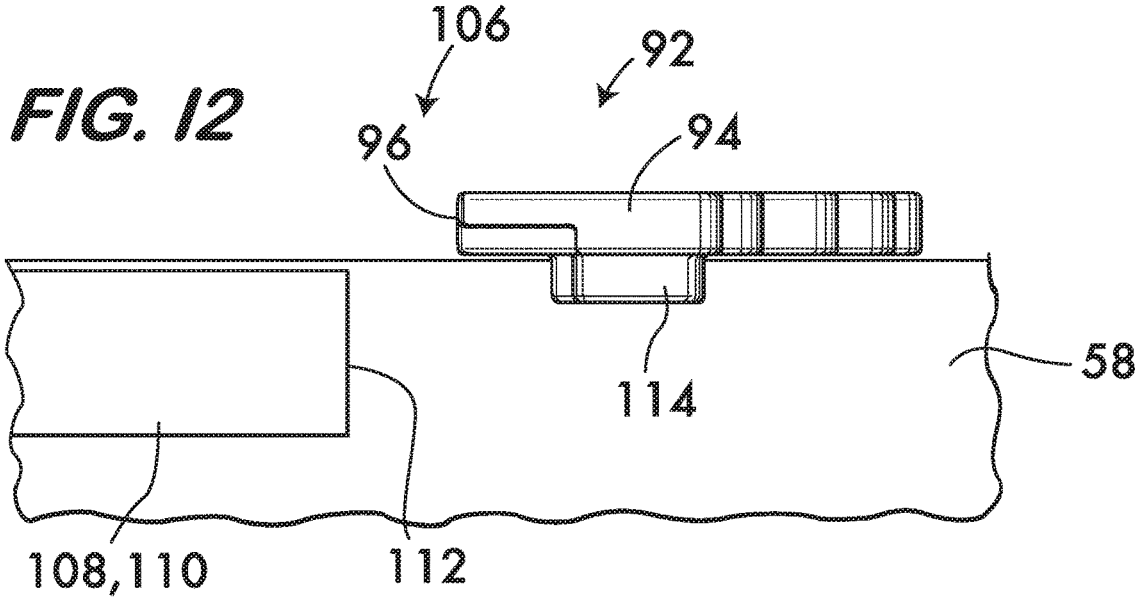
FIG. 12 is a side view of a portion of the selector interrupter shown in FIG. 11.

To avoid the lock up malfunction it is advantageous to use an interrupter mechanism 106, shown in FIGS. 10 and 12, to prevent the manipulation of the selector 92 in all positions of the fore-end chassis 88 but the forward most end of travel placing the action in battery (see FIG. 1). As shown in FIG. 10, an example interrupter 106 comprises an interrupter surface 108 mounted on the receiver 12. In this example the interrupter surface 108 comprises a wall 110 mounted on the receiver 12 between the right and left magazine tubes 26 and 58. In this particular embodiment the wall 110 extends lengthwise along the centerline of the shotgun 10. The interrupter surface 108 (wall 110) has an end 112 positioned distal to the right and left outer cut-offs 32 and 62. As shown in FIG. 12, interrupter 106 further comprises a boss 114 extending from the selector 92 toward the magazine tubes 26 and 58. In this example, the boss 114 extends the selector body 94. As shown in FIG. 11, the boss 114 is engageable with the interrupter surface 108 when the selector 92 is positioned between the wall's end 112 and the right and left outer cut-offs 32 and 62, thereby preventing movement of the selector body 94 transversely to the right and left magazine tubes 26 and 58. The wall's end 112 is positioned on receiver 12 such that it corresponds to a position of the fore-end chassis 88 which: 1) is substantially the full forward extent of travel of the fore-end chassis which places the action of shotgun 10 in battery; and 2) positions the selector 92 relatively to the wall's end 112 such that the boss 114 cannot engage the interrupter surface 108, thereby allowing motion of the selector body 94 transversely to the magazine tubes 26 and 58 (see FIG. 12). Thus the interrupter 106 permits selection of the right or left magazine only when the shotgun's action is in battery (the fore-end chassis 88 is fully forward) thereby preventing action lock up.

Figure 4:
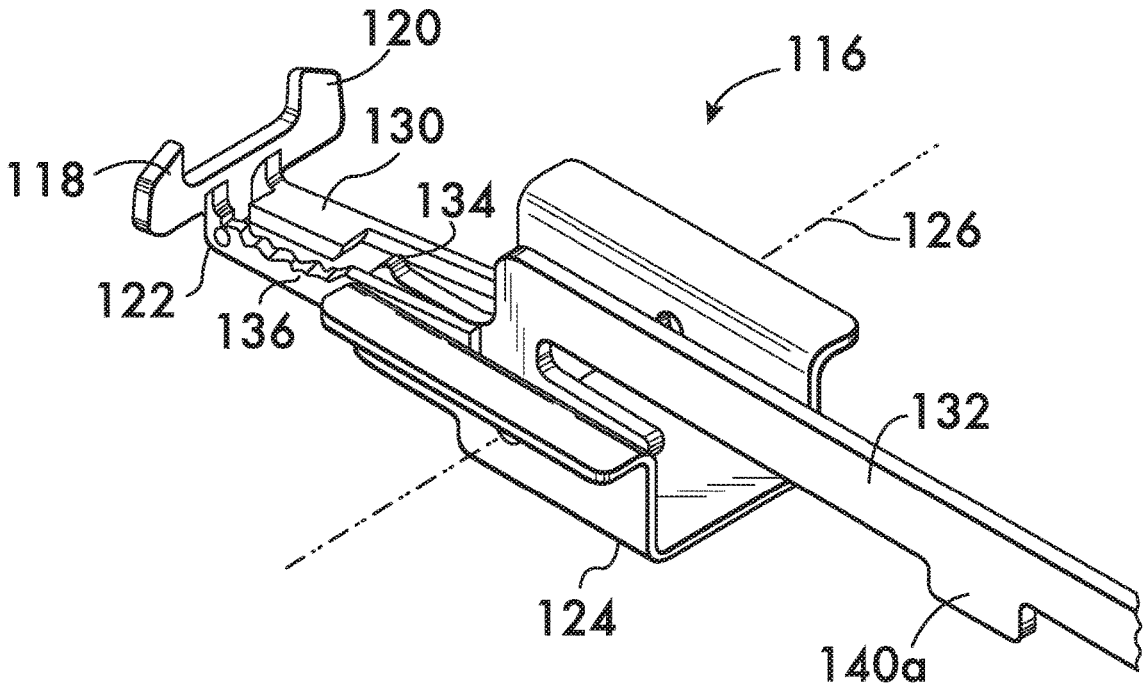
FIG. 4 is an isometric view of an example inner cut-off mechanism according to the invention.

As shown in FIGS. 4 and 5, the shotgun according to the invention further comprises an inner cut-off 116 mounted on the receiver 12. Similar to the outer cut-offs 32 and 62, the inner cut-off 116 is mounted on the receiver via magazine tubes 26 and 58. Inner cut-off 116 has first and second blocking surfaces 118 and 120 movable between a first position (see FIG. 6) respectively blocking the right and the left bores 28 and 60 of the right and left magazine tubes 26 and 58, and a second position (see FIG. 5) not blocking the right and left bores. In the example embodiment shown, the blocking surfaces 118 and 120 are mounted on a lever 122. Lever 122 is pivotably mounted on a housing 124 which in turn is mounted on the magazine tubes 26 and 58. Lever 122 is pivotable about an axis 126 oriented transversely to the magazine tubes 26 and 58. An inner biasing spring 128 acting between the housing 124 and the lever 122 biases the first and second blocking surfaces 118, 120 into the second (not blocking) position. An inner cam follower 130 is mounted on the lever 122. An inner cut-off cam 132, slidably mounted on the receiver 12 beneath the magazine tubes 26 and 58, engages the inner cam follower 130 for pivoting the first and second blocking surfaces 118 and 120 between the first and second positions. As shown in FIG. 9A and in a comparison of FIGS. 5 and 6, the inner cut-off cam 132 comprises an angled nose 134 which is engageable with an inner action surface 136 comprising the inner cam follower 130 on lever 122. Sliding motion of the inner cut-off cam 132 away from the muzzle end of shotgun 10 forces the angled nose 134 to engage the inner action surface 136 and pivot the lever 122 from the second (not blocking) to the first (blocking) position as described below and shown in FIG. 6. An inner cut-off cam actuator 138 movably mounted on the receiver 12 engages and moves the inner cut-off cam 132 into and out of engagement with the inner action surface 136. In this example, the inner cut-off cam actuator 138 is mounted on the fore-end chassis 88 (see FIG. 2). To move the lever 122 into the first (blocking) position shown in FIG. 6, the inner cut-off cam actuator 138 engages a tab 140*a* on the inner cut-off cam actuator 132 when the fore-end chassis 88 is moved away from the muzzle end of the shotgun to bring the action out of battery. Lever 122 is permitted to move back into the second (not blocking) position of FIG. 5 under the force of inner biasing spring 128 as the fore-end chassis 88 is moved toward the muzzle end of shotgun 10. As it moves toward the muzzle end of shotgun 10, the inner cut-off cam actuator 138 engages a second tab 140*b* on the inner cut-off cam actuator 138 (see FIGS. 9 and 9A), drawing the nose 134 out of engagement with the inner action surface 136 as the shotgun's action is returned to battery.

Operation of the example ammunition feed system 24 according to the invention is described beginning with FIGS. 1 and 2, with the shotgun's action in battery as evidenced by the forward position of the fore-end chassis 88. The user has selected the right magazine tube 26 from which to feed the next round into the chamber 18. Magazine selection is accomplished by depressing the left selector button 100 (see FIG. 10) to align the activation surface 96 of the selector 92 with the right cam 52. Transverse motion of the selector body 94 relative to the receiver 12 is permitted because the fore-end chassis 88 is fully forward, positioning the interrupter boss 114 forward of the end 112 of interrupter surface 108 (see FIG. 12). Right selector button 98 projects outwardly from the receiver 12 indicating right magazine selection.

In FIG. 5, the fore-end chassis 88 is drawn away from the muzzle end of shotgun 10 as indicated by the position of the inner cut-off cam actuator 138 which is mounted thereon. FIG. 5 shows the inner cut-off cam actuator 138 as it first engages the tab 140*a* of the inner cut-off cam 132 (see also FIGS. 4 and 9A). As further shown in FIG. 5, the right lever 34 of the right outer cut-off 32 is positioned so that its right blocking surface 42 is in the first position blocking the right bore 28 of the right magazine tube 26 and thereby retaining shell 30 within the tube. The inner cut-off 116 is in its second position with both its first and second blocking surfaces 118 (shown) and 120 not blocking the bores 28 and 60 of the magazine tubes 26 and 58 (see also FIG. 4).

Figure 6:
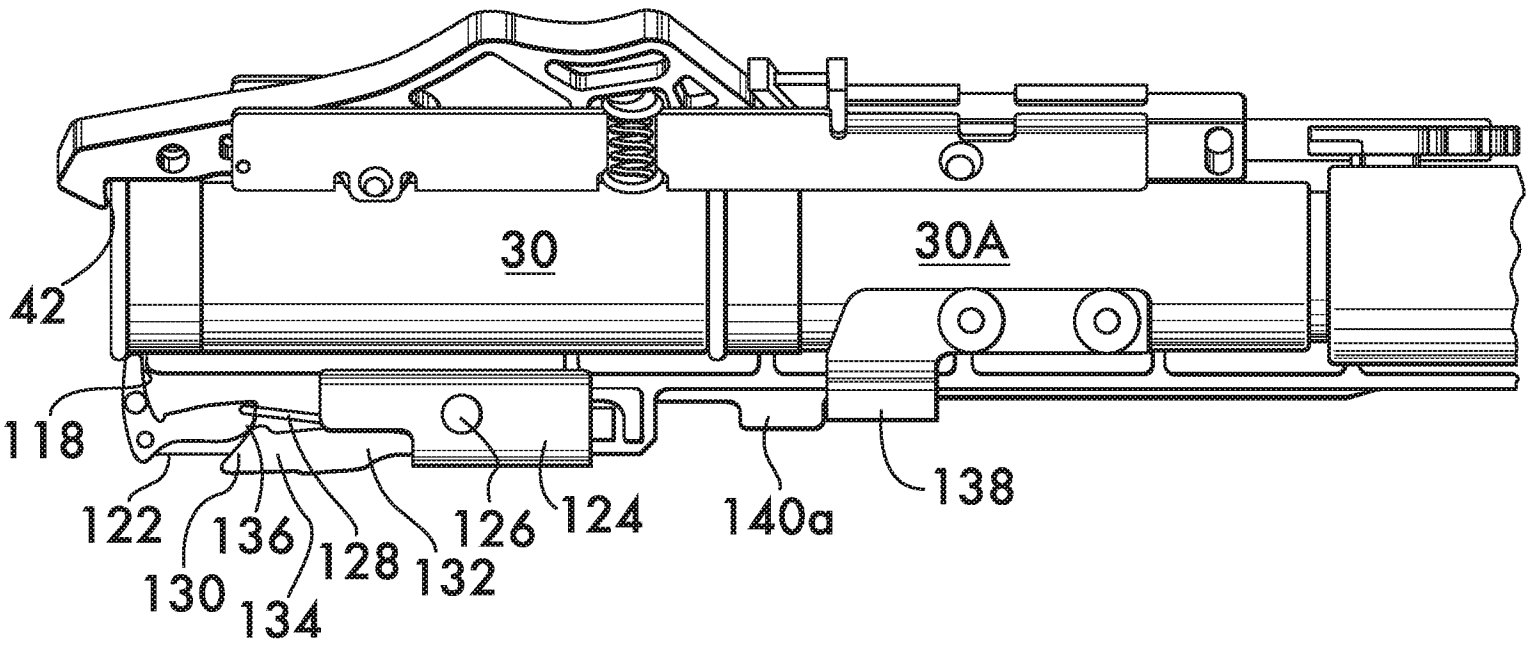

FIG. 6 shows continued motion of the fore-end chassis 88 which moves the inner cut-off cam actuator 138 against the tab 140, moving the inner cut-off cam 132 so that its angled nose 134 engages the inner action surface 136 of the inner cam follower 130. This engagement causes the lever 122 of the inner cut-off 116 to pivot clockwise about axis 126 and position the first and second blocking surfaces 118 and 120 (118 shown) into the first position blocking the bores 28 and 60 of the magazine tubes 26 and 58. Note that the first and second blocking surfaces 118 (shown) and 120 are offset toward the muzzle end of the shotgun from the right and left blocking surfaces 42 (shown) and 72 of the outer cut-offs 32 (shown) and 62 and thus will not prevent the shell 30 from being released from magazine tube 26. The first and second blocking surfaces 118 and 120 will however, catch the next shell, 30A, as described below.

Figure 7:
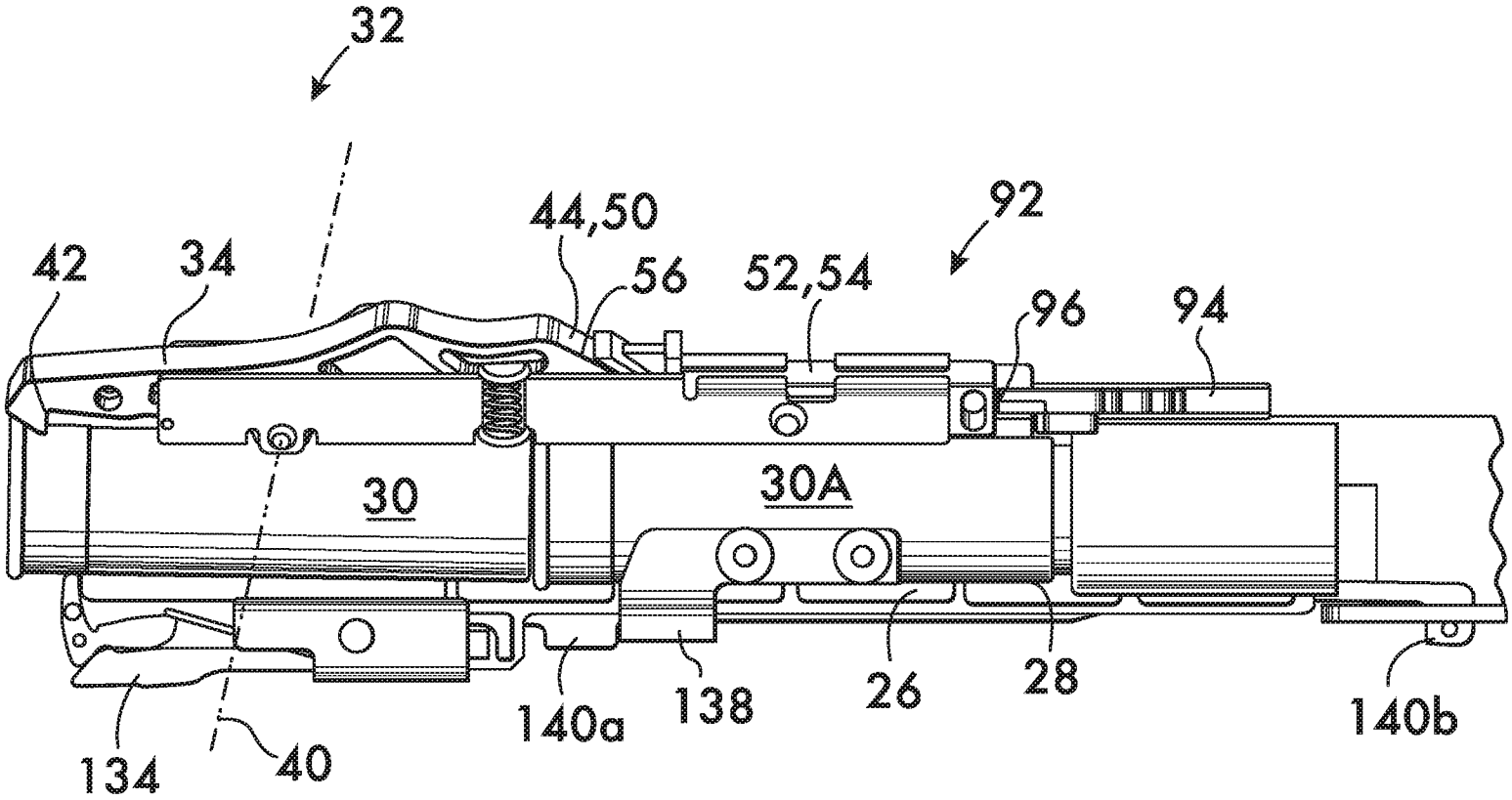

As shown in FIG. 7, continued motion of the fore-end chassis 88 causes the activation surface 96 of selector 92 to engage the right cam 52. Complementary ramp surface 56 of the right cam 52 engages the right ramp surface 50 of the right cam follower 44 on the right lever 34 of the right outer cut-off 32 (see also FIG. 3). Right lever 34 pivots clockwise about axis 40 and moves the right blocking surface 42 into its second position not blocking bore 28 of the right magazine tube 26 and thereby releasing the shell 30 which is shown beginning to move out of the magazine tube.

Figure 8:
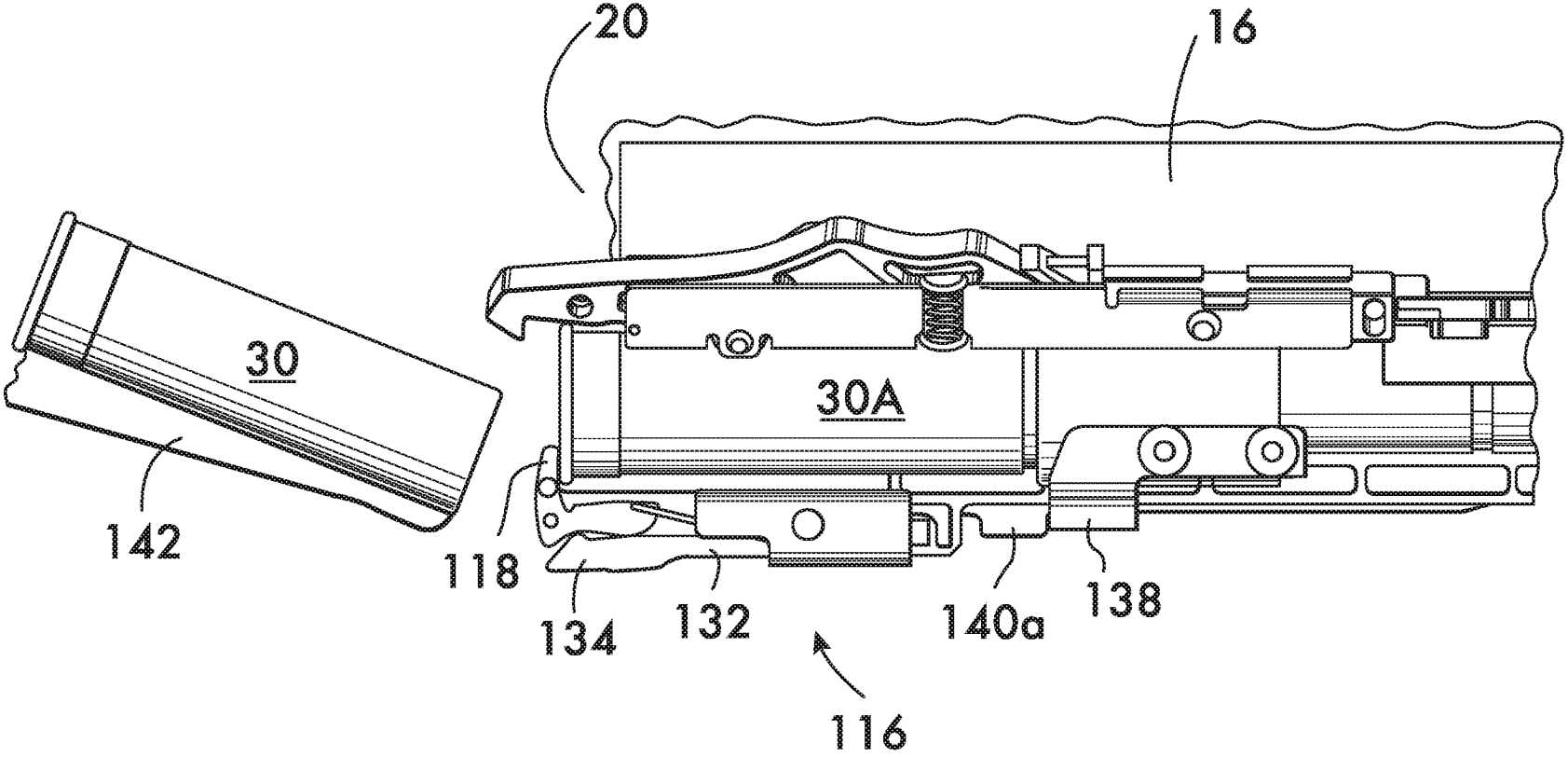

FIG. 8 shows shell 30 being received by an elevator 142 which subsequently raises the shell to the breech 20 be chambered (see FIG. 9). Meanwhile, the next shell 30A advances toward the end of the magazine tube 26 but is blocked and retained within the magazine tube as it engages the first blocking surface 118 of the inner cut-off 116 which is held in the blocking position by the inner cut-off cam 132 under the action of the inner cut-off cam actuator 138 acting on tab 140*a*.

Figure 9:
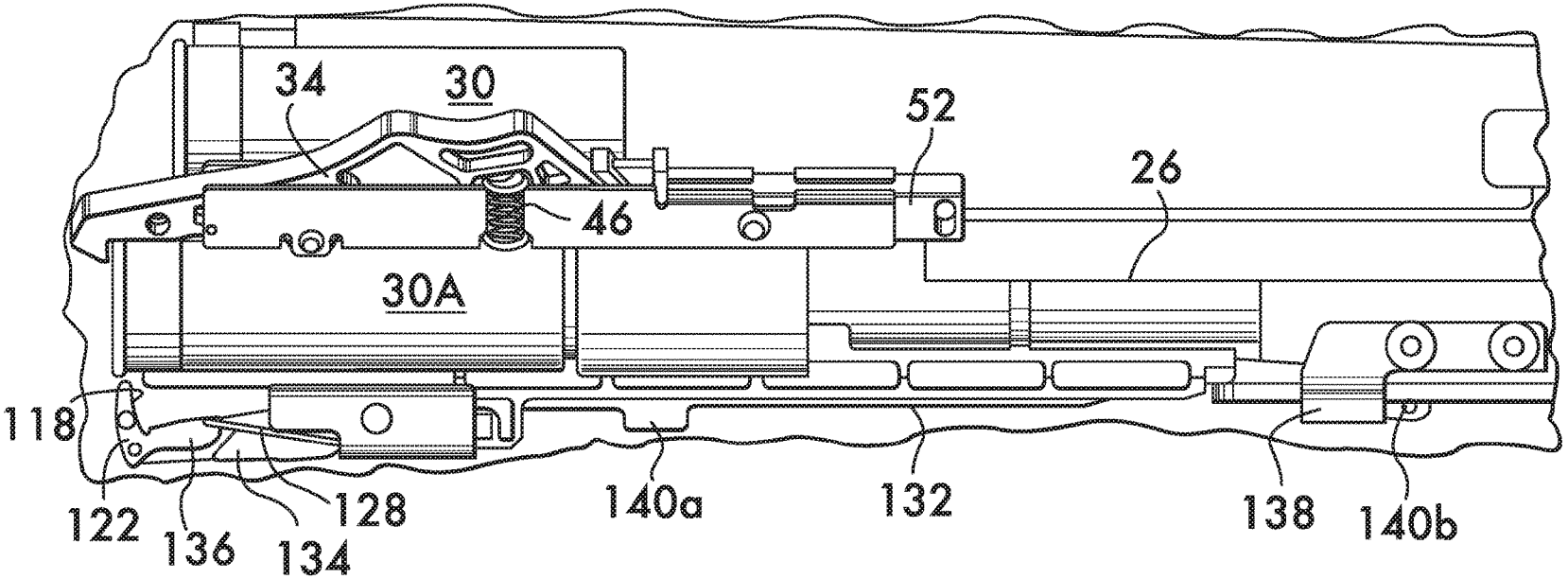
Figure 9A:
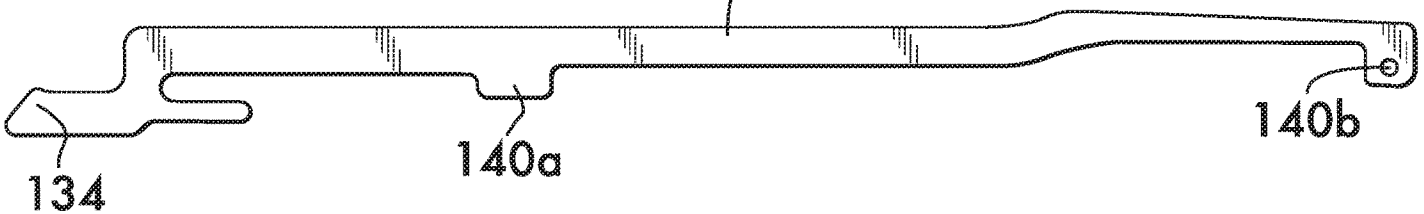
FIG. 9A is a side view of a component part of the example feeding mechanism according to the invention.

As shown by the position of the inner cam actuator 138 in FIG. 9, the fore-end chassis 88 is moved toward the muzzle end of the shotgun. This motion of chassis 88 disengages the activation surface 96 of selector 92 (not shown) from the right cam 52, thereby removing force from the right cam and allowing the cam's right return spring 53 (see FIG. 3) to move the right cam out of engagement with the right lever 34, thereby allowing the right biasing spring 46 to rotate the right lever 34 counterclockwise so as to position the right blocking surface 42 into its first position blocking the right magazine tube 26. Contemporaneously, the inner cam actuator 138 also disengages from the first tab 140*a* of the inner cut-off cam 132 and subsequently engages the second tab 140*b* (see also FIG. 9A). Upon this subsequent engagement, further motion of the inner cam actuator 138 draws the nose 134 of the inner cut-off cam 132 out of engagement with the inner action surface 136 of lever 122, allowing the lever to pivot counterclockwise under the force of inner biasing spring 128 and position the first and second blocking surfaces 118 (shown) and 120 back into the second (not blocking) position shown. Motion of the lever 122 is timed so that the first and second blocking surfaces 118 and 120 move into the second (not blocking) position only after the right blocking surface 42 of the right lever 34 has moved into its first (blocking) position. (The same timing conditions are also true for the left blocking surface 72 when ammunition feed is from the left magazine 58.) Synchronization of the motion of right lever 34 with lever 122 and the chambering of shell 30 is ensured by controlling the relative and absolute positions of the first and second tabs 140*a* and 140*b* on the inner cut-off cam 132. This condition is shown in FIG. 9 where shell 30A is retained within right magazine tube 26 by the right outer cut-off 32. Shell 30 has meanwhile been chambered as the action moves fully into battery. Note also that the selector 92 (see FIGS. 10-12) cannot be manipulated until the action is fully in battery and the boss 114 is clear of the interrupter surface 108 (wall 110) as shown in FIG. 12. This coordination of selector movement with selector position is expected to prevent locking up of the shotgun's action by preventing a second magazine from being selected before a shell has been chambered. Operation of the feeding system 24 when the left magazine tube 58 is selected is the same as when the right magazine tube is selected and is therefore not described in detail.

The design of the right and left outer cut-offs 32 and 62 and the inner cut-off 116 permits the left and right magazines 26 and 58 to be emptied without the need to cycle the action of shotgun 10. This is especially convenient when many shells are present in the magazines and is also safer because no rounds being removed need to be first chambered during the process. With the shotgun 10 in battery as shown in FIG. 1, removal of shell 30 from the right magazine 26 is effected by depressing the right manual actuator surface 48 so as to pivot right lever 34 clockwise. This pivoting motion will move the right blocking surface 42 into its second (not blocking) position, and, because the first and second blocking surfaces 118 and 120 of the inner cut-off 116 remain in their second (not blocking) position, shell 30 will be forced out of the right magazine 26 by the action of the magazine spring (not shown). Upon release from the magazine tube 26 shell 30 falls out of the shotgun 10 through the open bottom between the pistol grip 144 and the butt stock 146. If the right lever 34 is released then shell 30A will be captured and retained within the right magazine tube 26 by the right outer cut-off 32 as the right blocking surface 42 pivots back into its first (blocking) position under the action of right biasing spring 46. However, if the right lever 34 is continuously depressed then all of the shells within the right magazine tube 26 will be forced out. Removal of shells from the left magazine tube proceeds similarly.

Shotguns 10 according to the invention are expected to operate more reliably and with greater safety than those of the prior art.

What is claimed is:

1. A feeding system for feeding ammunition to a firearm, said feeding system comprising:

a right magazine tube mountable on said firearm, said right magazine tube defining a right bore for receiving said ammunition;

a right outer cut-off mountable on said firearm, said right outer cut-off having a right blocking surface movable between a first position blocking said right bore and a second position not blocking said right bore;

a right cam follower mounted on said right outer cut-off;

a right cam mountable on said firearm, said right cam being engageable with said right cam follower for moving said right blocking surface between said first and said second positions;

a left magazine tube mountable on said firearm, said left magazine tube defining a left bore for receiving said ammunition;

a left outer cut-off mountable on said firearm, said left outer cut-off having a left blocking surface movable between a first position blocking said left bore and a second position not blocking said left bore;

a left cam follower mounted on said left outer cut-off;

a left cam mountable on said firearm, said left cam being engageable with said left cam follower for moving said left blocking surface between said first and said second positions;

a selector mountable on said firearm, said selector having an activation surface in facing relation with said right and left cams, said selector being movable lengthwise along said first and second magazine tubes for engaging said activation surface with one of said left or right cams, said selector being movable transversely to said first and second magazine tubes for positioning said activation surface for engagement with one of said left or right cams.

2. The feeding system according to claim 1, further comprising:

an interrupter surface mountable on said firearm, said interrupter surface extending lengthwise along said first and second magazine tubes, said interrupter surface having an end positioned distal to said right and left outer cut-offs;

a boss extending from said selector, said boss being engageable with said interrupter surface when said selector is positioned between said end and said right and left outer cut-offs thereby preventing movement of said selector transversely to said right and left magazine tubes.

3. The feeding system according to claim 1, further comprising:

an inner cut-off mountable on said firearm, said inner cut-off having first and second blocking surfaces movable between a first position respectively blocking said right and said left bores, and a second position not blocking said right and left bores;

an inner cam follower mounted on said inner cut-off;

an inner cut-off cam mountable on said firearm, said inner cut-off cam being engageable with said inner cam follower for moving said first and second blocking surfaces between said first and second positions;

an inner cut-off cam actuator movably mountable on said firearm, said inner cut-off cam actuator being movable into engagement with said inner cut-off cam for moving said first and second blocking surfaces between said first and second positions.

4. The feeding system according to claim 3, wherein said inner cut-off comprises:

a housing mountable on said magazine tubes;

a lever mounted on said housing and pivotable about an axis oriented transversely to said magazine tubes.

5. The feeding system according to claim 3, further comprising a fore-end chassis mountable on said firearm and movable lengthwise along said right and left magazine tubes, said selector and said inner cut-off cam actuator being mounted on said fore-end chassis.

6. The feeding system according to claim 1, wherein said right outer cut-off comprises a right lever pivotably mountable on said right magazine tube, said right blocking surface being mounted on one end of said right lever, said right cam follower being mounted on an opposite end of said right lever.

7. The feeding system according to claim 6, wherein said left outer cut-off comprises a left lever pivotably mountable on said left magazine tube, said left blocking surface being mounted on one end of said left lever, said left cam follower being mounted on an opposite end of said left lever.

8. The feeding system according to claim 1, wherein said right cam comprises an elongate body slideably mountable on said right magazine tube.

9. The feeding system according to claim 8, wherein said left cam comprises an elongate body slideably mountable on said left magazine tube.

10. The feeding system according to claim 5, wherein said selector comprises:

a body mounted on said fore-end chassis and movable relatively thereto transversely to said right and left magazine tubes, said activation surface and said boss being mounted on said body;

a right button projecting from one side of said body transversely to said right and left magazine tubes; and a left button projecting from an opposite side of said body transversely to said right and left magazine tubes, said right and left buttons adapted for manual moving of said body transversely to said right and left magazine tubes.

11. The feeding system according to claim 2, wherein said interrupter surface comprises a wall mountable between said left and right magazine tubes.

12. The feeding system according to claim 1, wherein:

said right outer cut-off further comprises a right manual actuator surface extending therefrom;

said left outer cut-off further comprises a left manual actuator surface extending therefrom, said right and left manual actuator surfaces permitting manual moving of said right and left blocking surfaces between said first and second positions.

13. A shotgun, said shotgun comprising:

a receiver;

a barrel having a breech and a chamber, said barrel being mounted on said receiver;

a feeding system for feeding ammunition to said chamber, said feeding system comprising:

a right magazine tube mounted on said receiver, said right magazine tube defining a right bore for receiving said ammunition;

a right outer cut-off mounted on said receiver, said right outer cut-off having a right blocking surface movable between a first position blocking said right bore and a second position not blocking said right bore;

a right cam follower mounted on said right outer cut-off;

a right cam mounted on said receiver, said right cam being engageable with said right cam follower for moving said right outer cut-off between said first and said second positions;

a left magazine tube mounted on said receiver, said left magazine tube defining a left bore for receiving said ammunition;

a left outer cut-off mounted on said receiver, said left outer cut-off having a left blocking surface movable between a first position blocking said left bore and a second position not blocking said left bore;

a left cam follower mounted on said left outer cut-off;

a left cam mounted on said receiver, said left cam being engageable with said left cam follower for moving said left blocking surface between said first and said second positions;

a selector mounted on said receiver, said selector having an activation surface in facing relation with said right and left cams, said selector being movable lengthwise along said first and second magazine tubes for engaging said activation surface with one of said left or right cams, said selector being movable transversely to said first and second magazine tubes for positioning said activation surface for engagement with one of said left or right cams.

14. The shotgun according to claim 13, further comprising:

an interrupter surface mounted on said receiver, said interrupter surface extending lengthwise along said first and second magazine tubes, said interrupter surface having an end positioned distal to said right and left outer cut-offs;

a boss extending from said selector, said boss being engageable with said interrupter surface when said selector is positioned between said end and said right and left outer cut-offs thereby preventing movement of said selector transversely to said right and left magazine tubes.

15. The shotgun according to claim 13, further comprising:

an inner cut-off mounted on said receiver, said inner cut-off having first and second blocking surfaces movable between a first position respectively blocking said right and said left bores, and a second position not blocking said right and left bores;

an inner cam follower mounted on said inner cut-off;

an inner cut-off cam mountable on said shotgun, said inner cut-off cam being engageable with said inner cam follower for moving said first and second blocking surfaces between said first and second positions;

an inner cut-off cam actuator movably mounted on said receiver, said inner cut-off cam actuator being movable into engagement with said inner cut-off cam for moving said first and second blocking surfaces between said first and second positions.

16. The feeding system according to claim 15, wherein said inner cut-off comprises:

a housing mounted on said magazine tubes;

a lever mounted on said housing and pivotable about an axis oriented transversely to said magazine tubes.

17. The shotgun according to claim 15, further comprising a fore-end chassis mounted on said receiver and movable lengthwise along said right and left magazine tubes, said selector and said inner cut-off cam actuator being mounted on said fore-end chassis.

18. The shotgun according to claim 13, wherein said right outer cut-off comprises a right lever pivotably mounted on said right magazine tube, said right blocking surface being mounted on one end of said right lever, said right cam follower being mounted on an opposite end of said right lever.

19. The shotgun according to claim 18, wherein said left outer cut-off comprises a left lever pivotably mounted on said left magazine tube, said left blocking surface being mounted on one end of said left lever, said left cam follower being mounted on an opposite end of said left lever.

20. The shotgun according to claim 13, wherein said right cam comprises an elongate body slidably mounted on said right magazine tube.

21. The shotgun according to claim 20, wherein said left cam comprises an elongate body slidably mounted on said left magazine tube.

22. The shotgun according to claim 17, wherein said selector comprises:

a body mounted on said fore-end chassis and movable relatively thereto transversely to said right and left magazine tubes, said activation surface and said boss being mounted on said body;

a right button projecting from one side of said body transversely to said right and left magazine tubes; and a left button projecting from an opposite side of said body transversely to said right and left magazine tubes, said right and left buttons adapted for manual moving of said body transversely to said right and left magazine tubes.

23. The shotgun according to claim 14, wherein said interrupter surface comprises a wall mounted on said receiver between said left and right magazine tubes.

24. The shotgun according to claim 13, wherein:

said right outer cut-off further comprises a right manual actuator surface extending therefrom;

said left outer cut-off further comprises a left manual actuator surface extending therefrom, said right and left manual actuator surfaces permitting manual moving of said right and left blocking surfaces between said first and second positions.

25. A selector mountable on a shotgun having a plurality of ammunition magazines wherein respective cams for releasing said ammunition from said magazines are associated with each said magazine, said selector comprising a selector body defining an activation surface positionable in facing relation with said cams one at a time, said selector body being mountable on said shotgun and movable relatively to said cams for engaging said activation surface with a selected one of said cams.

26. The selector according to claim 25, wherein said selector body is movable transversely to said magazines for positioning said activation surface in facing relation with said selected one of said cams.

27. The selector according to claim 25, wherein said selector body is movable lengthwise along said magazines for engagement of said activation surface with said selected one of said cams.

28. The selector according to claim 25, further comprising:

an interrupter surface mountable on said shotgun, said interrupter surface extending lengthwise along said magazines, said interrupter surface having an end positionable distal to said cams;

a boss extending from said selector, said boss being engageable with said interrupter surface when said selector is positioned between said end and said cams thereby preventing movement of said selector transversely to said magazines.

29. A shotgun, said shotgun comprising:

a plurality of ammunition magazines;

respective cams for releasing ammunition from said magazines associated with each said cam;

a selector, said selector comprising a selector body mounted on said shotgun, said selector body defining an activation surface positionable in facing relation with said cams one at a time, said selector body being movable relatively to said cams for engaging said activation surface with a selected one of said cams.

30. The shotgun according to claim 29, wherein said selector body is movable transversely to said magazines for positioning said activation surface in facing relation with said selected one of said cams.

31. The shotgun according to claim 29, wherein said selector body is movable lengthwise along said magazines for engagement of said activation surface with said selected one of said cams.

32. The shotgun according to claim 29, further comprising:

an interrupter surface mounted on said shotgun, said interrupter surface extending lengthwise along said magazines, said interrupter surface having an end positionable distal to said cams;

a boss extending from said selector, said boss being engageable with said interrupter surface when said selector is positioned between said end and said cams thereby preventing movement of said selector transversely to said magazines.

33. The shotgun according to claim 29, further comprising a fore-end chassis movably mounted thereon, said selector body being mounted on said fore-end chassis.

34. The shotgun according to claim 33, further comprising an action, said fore-end chassis being connected to said action, motion of said fore-end chassis cycling said action into and out of battery during operation of said shotgun.

35. A shotgun, said shotgun comprising:

a receiver;

a plurality of ammunition magazines mounted on said receiver;

respective cut-offs for releasing ammunition from said magazines associated with each said cut-off, each of said cut-offs having a blocking surface movable between a first position blocking one of said magazines and a second position not blocking said one of said magazines;

at least one of said cut-offs having a manual actuator surface extending outwardly from said receiver, said manual actuator surface permitting manual moving of said blocking surface of said at least one cut-off between said first and second positions.

36. The shotgun according to claim 35, wherein said at least one cut-off comprises a lever pivotably mounted on one of said magazines, said blocking surface of said at least one cut-off being mounted proximate to one end of said lever, said manual actuator surface being mounted proximate to an opposite end of said lever.

* * * * *